US007048282B2

(12) United States Patent
Steiner et al.

(10) Patent No.: US 7,048,282 B2
(45) Date of Patent: May 23, 2006

(54) SPORTS DEVICE, PREFERABLY A SNOW OR WATER VEHICLE

(75) Inventors: Josef Steiner, Zug (CH); Adrian Bernet, Zürich (CH)

(73) Assignee: Bernstein Beteiligungs GmbH, Zug (CH)

( * ) Notice: Subject to any disclaimer, the term of this patent is extended or adjusted under 35 U.S.C. 154(b) by 161 days.

(21) Appl. No.: 10/181,806

(22) PCT Filed: Dec. 27, 2000

(86) PCT No.: PCT/CH00/00689

§ 371 (c)(1),
(2), (4) Date: Oct. 17, 2002

(87) PCT Pub. No.: WO01/52955

PCT Pub. Date: Jul. 26, 2001

(65) Prior Publication Data

US 2003/0098558 A1 May 29, 2003

(30) Foreign Application Priority Data

Jan. 24, 2000 (CH) ..... 132/00

(51) Int. Cl.
*B62D 57/00* (2006.01)

(52) U.S. Cl. ..... 280/18; 441/41; 441/66

(58) Field of Classification Search ..... 280/18, 280/20, 14.1, 21.1, 22, 28; 441/35, 40, 41, 441/66, 74; 114/61.25, 345
See application file for complete search history.

(56) References Cited

U.S. PATENT DOCUMENTS

| | | | | |
|---|---|---|---|---|
| 2,986,751 | A * | 6/1961 | Baren | 441/66 |
| 3,432,182 | A * | 3/1969 | Solipasso | 280/18 |
| 3,580,598 | A * | 5/1971 | de Pauw | 280/18 |
| 3,653,084 | A * | 4/1972 | Hartman | 441/40 |
| 4,114,230 | A * | 9/1978 | MacFarland | 15/330 |
| 4,206,933 | A * | 6/1980 | Koch | 280/18 |
| 5,101,752 | A * | 4/1992 | Smollar et al. | 114/345 |
| 5,732,650 | A * | 3/1998 | Peterson | 114/345 |
| 5,868,405 | A * | 2/1999 | Lavecchia et al. | 280/14.21 |
| 5,906,019 | A | 5/1999 | McCarthy et al. | |
| 6,010,381 | A * | 1/2000 | Peterson | 441/66 |

FOREIGN PATENT DOCUMENTS

| | | |
|---|---|---|
| DE | 34 34 384 | 8/1985 |
| DE | 297 05 403 | 5/1997 |

* cited by examiner

*Primary Examiner*—Christopher P. Ellis
*Assistant Examiner*—Brian Swenson
(74) *Attorney, Agent, or Firm*—Wenderoth, Lind & Ponack, L.L.P.

(57) ABSTRACT

A sports device (10), preferably a snow or water vehicle, has an outer shell (15) which when inflated, forms a support surface (13) underneath and a lying down or sitting surface (20) on top. An inflatable tubular shell (20) with two segments (21, 22) extending crosswise across it is provided in this outer shell (15). The outer shell (15) is formed of a robust fabric which is coated or laminated with plastic. The tubular shell (20), which is in itself separate from the outer shell, is produced from plastic films, preferably without any fabric reinforcement. The outer shell may also be connected to the tubular shell in such a way that they form a single film. The sports device can therefore be produced with optimal materials for the outer shell or the tubular shell, with the result that it has a long service life.

18 Claims, 3 Drawing Sheets

SPORTS DEVICE, PREFERABLY A SNOW OR WATER VEHICLE

BACKGROUND OF THE INVENTION

The invention relates to a sports device, preferably a snow or water vehicle, which can be inflated with a medium, especially air, and which comprises an outer shell, which when inflated forms a support surface underneath and a lying or sitting surface on top.

A generic sports device according to the document DE-A-34 34 384, which relates to an air-cushion toboggan, provides four longitudinal rolls arranged side by side, which can be inflated with air. The rolls at the two outer sides are parallel to one another at the rear end and arranged conically at the front, tapering inwards towards a point, while the two inner rolls extend in the longitudinal direction of the toboggan, and, in this context, serve as the sitting area of the toboggan. The outer rolls are each fitted with guide runners underneath, which taper at the front towards a point. Furthermore, handles, which the driver can hold during travel, are fitted to the upper side of the outer rolls.

One problem with this toboggan relates to its manufacture wherein it is necessary to ensure that the rolls are manufactured from a sufficiently rigid material. Because, if the toboggan were to travel over an object, for example a protruding, pointed stone, a hole could quickly appear in the shell affected and the air pressure provided would immediately decline. Accordingly, the toboggan could only be driven with difficulty or not at all. A further disadvantage is that during travel, the driver must displace his weight to the outer side of the toboggan in order to make a curve. Because of the centrifugal force acting on the driver when travelling in a curve, there is a risk that he may fall sideways from the toboggan.

SUMMARY OF THE INVENTION

The present invention is therefore based upon the object of creating a sports device of the type mentioned in the introduction, which is constructed with increased safety and corresponding strength with the purpose of providing a longer service life. Furthermore, the present sports device should provide improved steering capability.

This object is achieved according to the invention in that an inflatable tubular shell is integrated inside the outer shell, which is either at least partially separate or connected to the outer shell, and that at least one connecting segment extending crosswise through it is provided, which connects the lower support surface to the lying or sitting surface located above it.

By providing the outer shell and the tubular shell contained inside it, the sports device according to the present invention creates the substantial advantage that the outer shell can be made from a material, which is very resistant to contact with solid objects and to frictional wear, and furthermore, as an advantage in manufacturing, can be fitted without difficulty with accessory components such as runners, handles, eyelets etc.

By contrast, the inner tubular shell, which advantageously is formed of a single film together with the outer shell, can be fitted with a material specific for its purpose. Accordingly, this device can also be fitted with runners to allow very simple and effective steering.

In one very advantageous embodiment, the outer shell and tubular shell, manufactured in each case from an upper and a lower film layer, are welded together around the lateral perimeter by means of a continuous seam, whereby the outer shell comprises a robust fabric, which is coated or laminated with a synthetic material, while the tubular shell comprises a synthetic film. Accordingly, optimum conditions are provided for a safe sports device with a long service life.

Further embodiments of the invention and additional advantages will be presented below with reference to the drawings. The drawings are as follows:

DETAILED DESCRIPTION OF THE INVENTION

Figure 1:
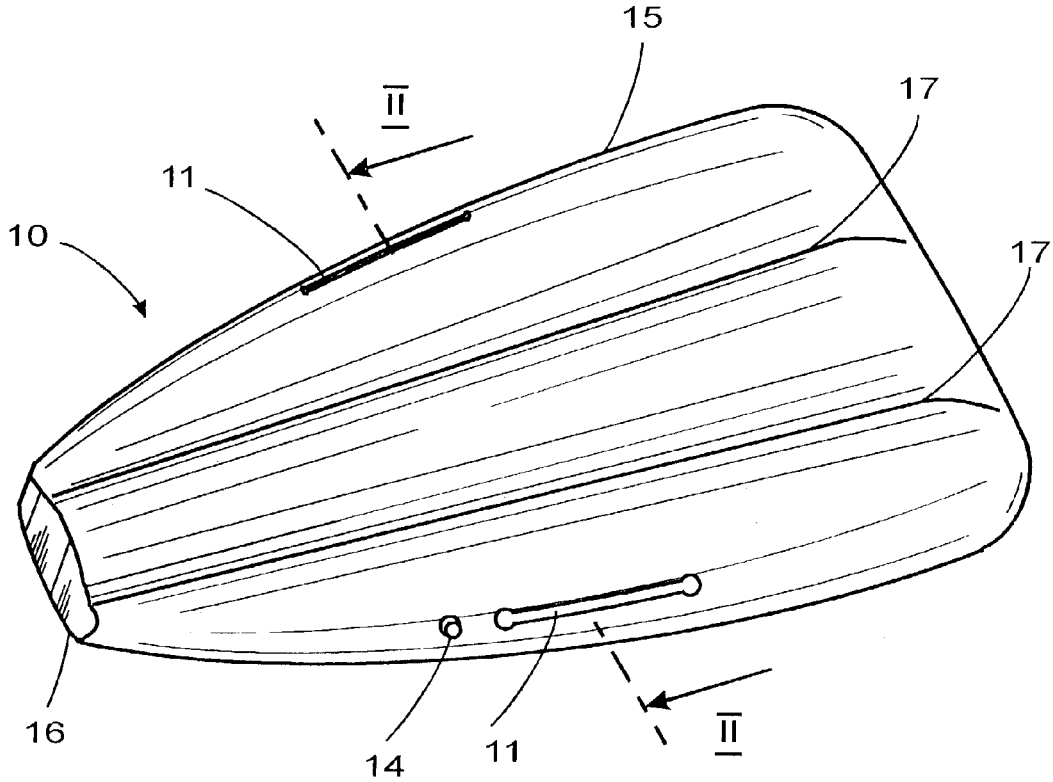
FIG. 1 is a perspective view of a sports device according to the present invention.

FIG. 1 shows a sports device 10, which, in the present embodiment, is especially designed as a toboggan, but could essentially be used as any desired snow vehicle or water vehicle. This sports device 10 is inflated with a medium, especially air, and comprises an outer shell 15, which when inflated forms a lower support surface 13 and an upper lying or sitting surface 12.

Figure 2:
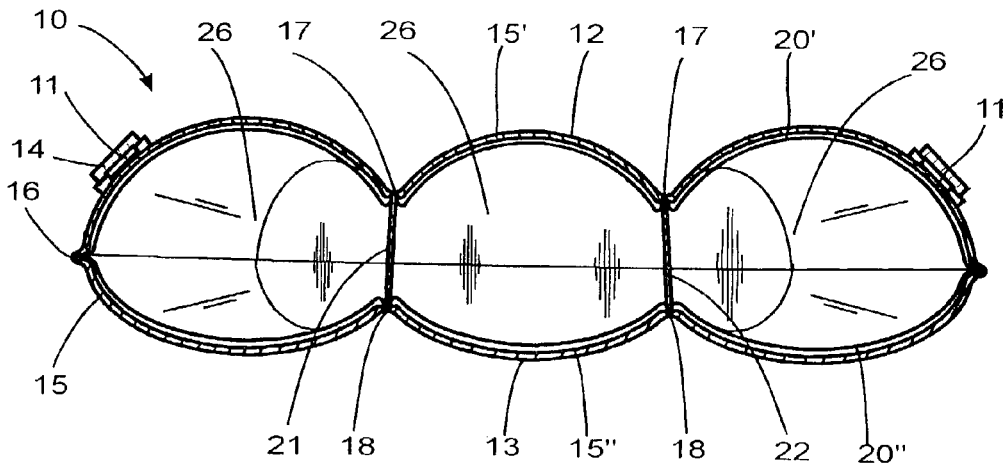
FIG. 2 is a cross-sectional view through the sports device according to FIG. 1 along the line II—II.

In FIG. 2, an inflatable tubular shell 20 is provided according to the invention with two connecting segments 21, 22 extending crosswise through it. The connecting segments connect the lower support surface 13 to the upper lying or sitting surface 12 of the outer shell 15 in order to limit the spacing and provide shape to the outer shell.

The outer shell 15 and the tubular shell 20 are each manufactured from two correspondingly dimensioned pairs of film 15', 20'; 15", 20", one of which forms the upper side and the other forms the lower side of the device 10. The two-part tubular shell 20, with its film layers 20', 20", is of approximately the same dimensions as the associated film layers 15', 15" of the outer shell 15. These superimposed film pairs 15', 20'; 15", 20" are welded together at the lateral perimeter by means of a continuous seam 16, so that an enclosed chamber is formed inside the tubular shell 20.

The outer shell 15 is made from a robust fabric, which is coated or laminated with an appropriate synthetic material, and the tubular shell 20, which is per se separate from the latter is made from at least one synthetic-material film. The upper film 15' of the outer shell 15 comprises a rough outer surface, so that a person seated on it will not slip. The inside of this film 15' is coated or laminated with a synthetic material, so that it can be welded together with the per se separate tubular shell 20 and the lower film.

The lower film 15" is also manufactured from a robust fabric, which is coated or laminated on both sides with a synthetic material. The inside of the lower film is preferably coated or laminated with the same synthetic material as the inside of the upper film 15'. The lower side of the lower film 15" is coated or laminated with a synthetic material providing very good gliding properties, so that the sports device glides well on snow or water.

In one very advantageous embodiment, the upper film 15' of the outer shell 15 comprises a GORE-TEX® CORDURA® fabric coated with polyurethane TPU and/or a nylon fabric, while the lower film 15", 55" is manufactured from a robust KELVAR® (poly-paraphenylene terephthalamide), TELFON® (polyterafluoroethylene) or nylon fabric. The interior side of both films are coated or laminated with polyurethane TPU. The outer side of the upper film which forms the sitting surface is uncoated, while the outer side of the lower film 15", 55" which forms the gliding surface, is coated or laminated with a PVC or TPU synthetic material provided with good gliding properties. The tubular shell 20 is manufactured from polyurethane TPU preferably without additional fabric. This combination of materials provides, in particular, the advantage that the two different shells can be very readily welded together. Of course, other materials, which fulfil the required properties for this sports device 10, may in principle also be used.

Within the context of the invention, two connecting segments 21, 22 running approximately symmetrical to the longitudinal central axis of the outer shell 15 are provided. Each of these connecting segments 21, 22, which are also manufactured from a synthetic material corresponding to the fabric coating, is welded together to form the support surface 13 underneath and the seating surface 12 on top of the outer shell 15 and the tubular shell 20, in each case forming a longitudinal seam 17, 18, thereby creating one longitudinal roll in the center and one at each outer side. In accordance with FIG. 1, a continuous longitudinal seam 17, 18 results in a uniform, straight dividing line between the rolls.

The connecting segments 21, 22 are formed approximately along the entire length of the outer shell 15. However, a connection between the individual chambers 26 is provided at the front and the back, so that only one valve 14 is required for inflation and deflation with air. This provides the further advantage that when the driver shifts his weight, the air can escape into the unloaded chambers. In principle, however, the three chambers 26 could be separated from one another, and a separate valve 14 could be allocated to each one.

When welding together the film layers 15', 15"; 20', 20" and the connecting segments 21, 22, the connections through the longitudinal seams 17, 18 are produced first; and the seam 16 at the outer perimeter is only produced after this, advantageously by means of a known high-frequency electrical welding technique.

When inflated, the outer shell 15 forms a mattress shape, as shown in FIG. 1, and in this context tapers laterally towards the front. Moreover, a handle 11 is attached at each side. This provides the further advantage that, any accessory components such as handles 11, eyelets, pockets and other features can be attached to this outer shell 15, without the occurrence of problems relating to sealing, because the tubular shell is separate from these accessory components. Only the valve 14 extends through the outer shell into the tubular interior.

The materials for the outer shell 15, the tubular shell 20 and connecting segments 21, 22 are designed to be flexible so that the device 10 can readily be folded and stored, for example, in a rucksack.

Figure 3:
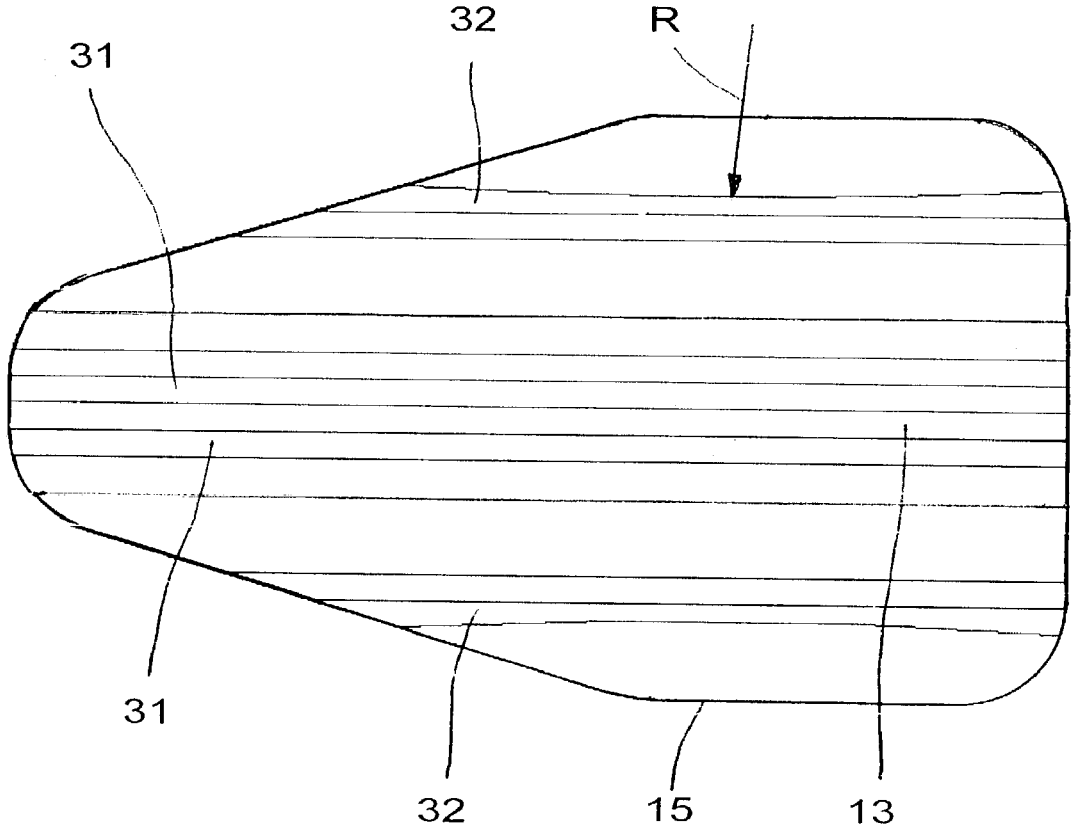
FIG. 3 is a bottom plan view of the sports device according to FIG. 1.

FIG. 3 shows the sports device 10 from below, illustrating its runners 31, 32 arranged in the longitudinal direction, and attached to the support surface 13 of the outer shell 15. The two outer runners 32 are not straight, but are curved outwards with a radius R. Accordingly, the driver can shift his weight to the inner side of the toboggan thereby producing increased pressure on one of these two runners 32. This slightly tapering design of the runners 32 allows the toboggan to produce curves as it were automatically when the weight is shifted to one or the other of these runners. The radius R is preferably on the order of magnitude between 5 and 20 meters.

Figure 4:
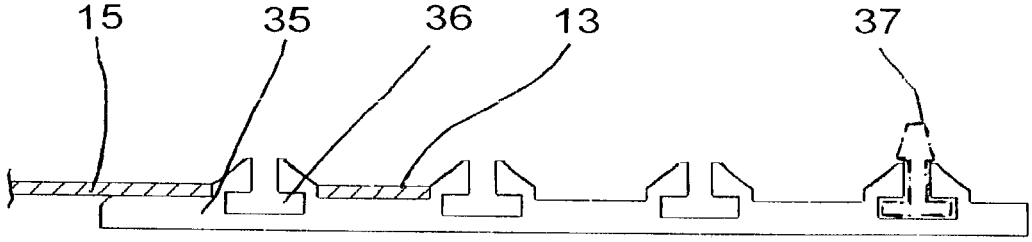
FIG. 4 is a partial cross-sectional view of the outer shell with a support surface and attachable runners as a design variant.

In accordance with FIG. 4, as a design variant, a profiled plate 35 with several T-grooves 36 arranged adjacently for retaining the runners 37 is welded onto the support surface 13 of the outer shell 15. This illustrates that with the design of the device according to the invention, various solutions can be implemented depending on requirements.

Figure 5:
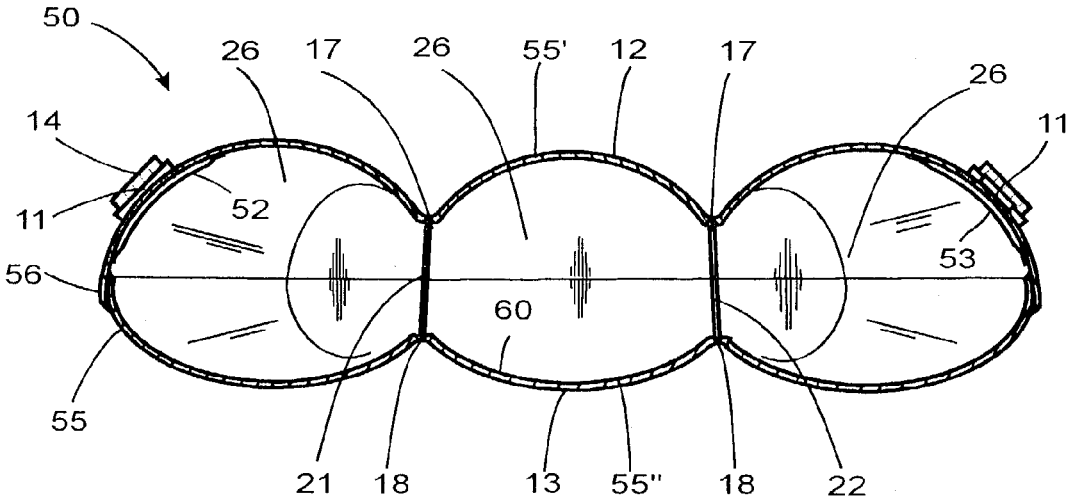
FIG. 5 is a cross-sectional view through a sports device in a design variant in which the outer shell and the tubular shell consist of a single film.

FIG. 5 shows a sports device 50, which is essentially constructed in the same manner as that shown in FIG. 1. For this reason, the same reference characters are used to refer to the same components. By contrast with the design according to FIG. 1, an outer shell 55 and a tubular shell 60 are provided; these are connected to one another and form a single film. Again, an upper and a lower film are provided, which are welded together laterally by means of an overlap 56.

Figure 6:
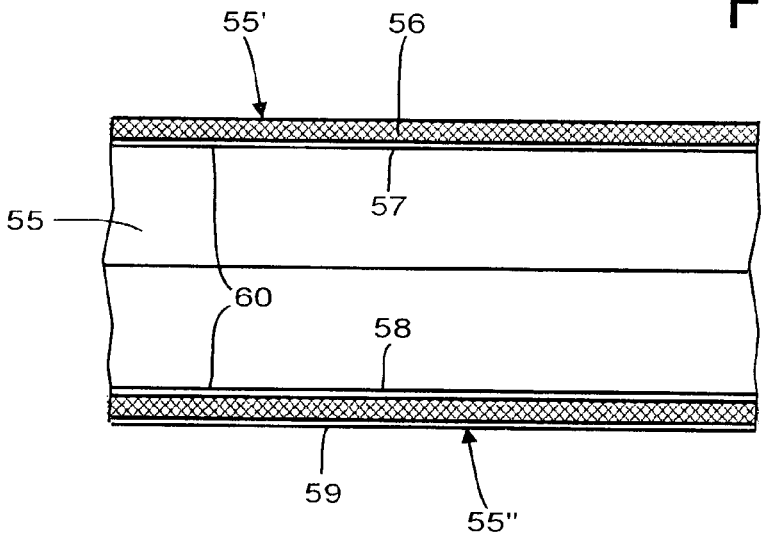
FIG. 6 is a partial longitudinal section through the sports device according to FIG. 5.

In accordance with FIG. 6, the outer shell 55 is manufactured from a robust fabric, which, again, is coated or laminated with synthetic material. For this purpose, the upper film 55' comprises a rough outer surface with the robust fabric 56. On the inside 57, it is coated or laminated with synthetic material and thereby forms the tubular shell. The lower film 55" is also made from the robust fabric 56, moreover, coated or laminated on the inside 58 with synthetic material to form the tubular shell, and provided with the appropriate, synthetic material offering good gliding properties on the outside 59 to form the gliding surface.

Moreover, in the case of this sports device 50, it is advantageous for a separate piece of film 52, 53 to be attached, especially welded, in each case to the inside of the tubular shell 60 at all positions, at which accessory components, such as runners, handles 11, eyelets or the valve are attached to the outer shell 55, so that an additional seal is provided at these positions.

This sports device is preferably used as a toboggan, which can be steered very easily and is also suitable for deep snow.

With reference to the exemplary embodiments described above, the invention has been adequately explained. However, it could be presented in still further variants. In principle the tubular shell could also be manufactured completely separately from the outer shell and inserted into the latter and advantageously attached to it.

Furthermore, only one or more than two crosswise-extending connecting segments could be provided inside the tubular shell 20.

The outer shell and also the tubular shell could in each case comprise a sock-shaped shell only being connected together at the front and the rear. Also, their outer shape could, of course, be designed differently from the examples presented, for instance, being rounded, oval, elliptical or similar shape.

The invention claimed is:

1. An inflatable sports device comprising:

an outer shell forming a lower support surface and an upper support surface for supporting an individual in a sitting or lying position;

an inflatable tubular shell disposed inside of said outer shell, wherein said inflatable tubular shell is connected to said outer shell; and at least one connecting segment formed of a synthetic material and extending longitudinally across said inflatable tubular shell and connecting the lower support surface to the upper support surface, wherein said connecting segment is welded to the lower support surface, the upper support surface, and the inflatable shell so as to form a longitudinal seam, wherein the upper support surface of said outer shell comprises a rough surface, while the lower support surface comprises a low-friction surface.

2. The inflatable sports device as claimed in claim 1, wherein said outer shell comprises: an upper film made of a polyurethane-coated fabric and/or a nylon fabric; and a lower film made of poly-paraphenylene terephthalamide, polytetrafluoroethylene or nylon fabric, wherein the interior surfaces of both of the upper and lower films are coated with polyurethane, and the outer surface of the upper film is uncoated while the outer surface of the lower film is coated with a PVC or TPU synthetic material to provide a low friction surface.

3. The inflatable sports device as claimed in claim 1, further comprising at least one accessory component connected only to said outer shell, and a valve extending though said outer shell and into the interior of said tubular shell.

4. The inflatable sports device as claimed in claim 1, wherein, when said tubular shell is inflated, said outer shell tapers toward a front thereof.

5. The inflatable sports device as claimed in claim 1, wherein the materials forming said outer shell, said tubular shell and said connecting segments are foldable.

6. The inflatable sports device as claimed in claim 1, further comprising a profiled plate welded to the lower support surface of said outer shell, wherein said profiled plate is adapted to retain runners thereon.

7. The inflatable sports device as claimed in claim 1, wherein said outer shell is made from a durable fabric which is coated with a synthetic material, and said tubular shell is made from at least one synthetic material film, which does not include a fabric reinforcement.

8. The inflatable sports device as claimed in claim 7, further comprising an accessory component attached to said outer shell and a separate piece of film attached to the inside of said tubular shell at the location at which said accessory component is attached so as to form an additional seal.

9. The inflatable sports device as claimed in claim 8, wherein said accessory component comprises one of a runner, a handle, an eyelet and a valve.

10. The inflatable sports device as claimed in claim 1, wherein said outer shell is made from a durable fabric which is coated with a synthetic material, and said tubular shell is made from at least one synthetic material film.

11. The inflatable sports device as claimed in claim 10, wherein said outer shell and said tubular shell are each constructed of two film layers having outer edges that are connected along an outer peripheral seam.

12. The inflatable sports device as claimed in claim 1, wherein said outer shell and said tubular shell are welded together at a lateral perimeter so as to define a continuous seam.

13. The inflatable sports device as claimed in claim 12, wherein the continuous seam comprises a butt-seam or an overlapping seam.

14. An inflatable sports device comprising:

an outer shell forming a lower support surface and an upper support surface for supporting an individual in a sitting or lying position:

an inflatable interior shell disposed inside of said outer shell, wherein said inflatable interior shell is connected to said outer shell; and a plurality of interior connecting segments formed of synthetic material and extending longitudinally across said interior shell and said outer shell, wherein each of said interior connecting segments connects the lower support surface to the upper support surface, wherein said connecting segments are welded to the lower support surface, the upper support surface, and the interior shell so as to form a plurality of parallel longitudinal seams, wherein the upper support surface of said outer shell comprises a rough surface, while the lower support surface comprises a low-friction surface.

15. The inflatable sports device as claimed in claim 14, wherein the longitudinal seams are disposed symmetrically with respect to a longitudinal central axis of said outer shell thereby creating a central longitudinal roll and opposite side rolls.

16. The inflatable sports device as claimed in claim 14, wherein said connecting segments extend substantially the entire length of said outer shell so as to form a plurality of chambers within said interior shell, and the chambers are in fluid communication with each other.

17. The inflatable sports device as claimed in claim 14, further comprising a profiled plate welded to the lower support surface of said outer shell, wherein said profiled plate is adapted to retain runners thereon.

18. The inflatable sports device as claimed in claim 17, wherein said profiled plate forms a plurality of T-shaped grooves for receiving a plurality of runners, respectively.

* * * * *